US006271872B1

(12) United States Patent
Nagata

(10) Patent No.: US 6,271,872 B1
(45) Date of Patent: Aug. 7, 2001

(54) HEAD CLEANING METHOD AND DEVICE FOR THERMAL PRINTER, AND RECORDING SHEET ROLL FOR THE SAME

(75) Inventor: Atsushi Nagata, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/635,407

(22) Filed: Aug. 10, 2000

(30) Foreign Application Priority Data

Aug. 11, 1999 (JP) ..... 11-227523

(51) Int. Cl.[7] ..... B41J 2/32
(52) U.S. Cl. ..... 347/171
(58) Field of Search ..... 347/221, 171; 400/701, 702

(56) References Cited

U.S. PATENT DOCUMENTS 5,926,197 * 7/1999 Kessler ..... 347/221

FOREIGN PATENT DOCUMENTS 60-49985 * 3/1985 (JP) ..... 347/171
61-43584 * 3/1986 (JP) ..... 347/171
63-114691 * 5/1988 (JP) ..... 347/171
WO93/21020 * 10/1993 (WO) ..... 347/171

* cited by examiner

*Primary Examiner*—Huan Tran
(74) *Attorney, Agent, or Firm*—Sughrue, Mion, Zinn, Macpeak & Seas, PLLC

(57) ABSTRACT

A thermal printer includes a capstan roller and pinch roller, which feed a continuous color thermosensitive recording sheet from a recording sheet roll. A thermal head operates for image recording to the continuous recording sheet. A roll loading chamber is loaded with one of the recording sheet roll and a cleaning sheet roll. The cleaning sheet roll includes a continuous cleaning sheet wound in a roll form, and discernment indicia provided in a predetermined position. An information reading photoelectric sensor reads the discernment indicia. A controller causes the capstan roller and pinch roller to feed the continuous cleaning sheet when the discernment indicia is read, to wipe and clean the thermal head with the continuous cleaning sheet. In a preferred embodiment, a cutter precuts the continuous recording sheet in a precutting position distant by a predetermined length from a front edge of the continuous recording sheet, to remove a front edge portion.

24 Claims, 7 Drawing Sheets

HEAD CLEANING METHOD AND DEVICE FOR THERMAL PRINTER, AND RECORDING SHEET ROLL FOR THE SAME

BACKGROUND OF THE INVENTION

1. Field of the Invention

The present invention relates to a head cleaning method and device for a thermal printer, and a recording sheet roll for the same. More particularly, the present invention relates to a head cleaning method and device for a thermal printer, and a recording sheet roll for the same, with which a thermal head can be cleaned with good efficiency.

2. Description Related to the Prior Art

There is a thermal printer in which heating elements of a thermal head is pressed against a recording surface of a thermosensitive recording sheet. An image is recorded by color development of the recording sheet. An example of the recording sheet is continuous, and is wound in a form of a recording sheet roll to be loaded in the thermal printer. After the image recording, a cutter in the thermal printer cuts the continuous recording sheet to obtain a print sheet with an image.

A front edge of the recording sheet roll in an unused state is likely to have an unwanted curvature, has an inclination to a direction perpendicular to lateral edges, or other features with low quality. A known model of the thermal printer is constructed to execute a precutting process, in which the front edge of the recording sheet roll is cut neatly upon newly setting the recording sheet roll in the thermal printer. In the precutting process, the continuous recording sheet is drawn from the recording sheet roll. A portion having the front edge is cut away at a predetermined precutting length, and is removed and ejected from the thermal printer. The precutting process, for example, is effected upon detection of closing of a lid for a roll loading chamber after the recording sheet roll is set in the roll loading chamber.

It is likely that dirt, dust or the like sticks to the heating element array of the thermal head. The dirt may have been stuck on the recording sheet. The dust may be particles created from a protective layer in the recording sheet. The thermal head must be cleaned periodically because dirt of the thermal head will influence the printing quality. To clean the thermal head, there is a cleaning sheet roll for maintenance as accessory to the recording sheet roll. The cleaning sheet roll is a roll of a continuous cleaning sheet having an abrasion layer, and has appearance similar to that of the recording sheet roll. The cleaning sheet roll is set in the thermal printer for cleaning operation instead of the recording sheet roll.

When a cleaning command signal is input with the cleaning sheet roll set in the thermal printer, the continuous cleaning sheet is drawn from the cleaning sheet roll, and fed to a position between the thermal head and a platen roller. When a portion of the cleaning sheet with a predetermined length is passed between the thermal head and the platen roller, the cleaning sheet is stopped in a temporary manner. One of the thermal head and the platen roller is moved to the remainder to squeeze the cleaning sheet. The cleaning sheet starts again being fed. The abrasion layer is rubbed on the heating elements to wipe away dirt or dust from those. The cleaning sheet having rubbed the thermal head is cut by the cutter in the same manner as the recording sheet, and is ejected from the thermal printer.

As the thermal printer executes the precutting process automatically, a front portion of the cleaning sheet is automatically precut upon setting of the cleaning sheet roll. This is a wasteful operation, because the precutting process is irrespective of the unused state of the front portion of the cleaning sheet, and discards the front portion in vain. Also, a user is likely to mistake the precutting process for a cleaning process, and remove the cleaning sheet roll without using the cleaning sheet roll for cleaning the thermal head.

SUMMARY OF THE INVENTION

In view of the foregoing problems, an object of the present invention is to provide a thermal printer, a head cleaning method and a recording sheet roll with which a thermal head can be cleaned with good efficiency and without errors in use of a cleaning sheet.

In order to achieve the above and other objects and advantages of this invention, a thermal printer includes a feeder for feeding a continuous recording sheet from a recording sheet roll. A thermal head operates for image recording to the continuous recording sheet being fed. A roll loading station is loaded with one of the recording sheet roll and a cleaning sheet roll, the cleaning sheet roll including a continuous cleaning sheet wound in a roll form, and discernment information provided in a predetermined position. An information reader reads the discernment information. A controller causes the feeder to feed the continuous cleaning sheet when the discernment information is read, to wipe and clean the thermal head with the continuous cleaning sheet.

Furthermore, a cutter precuts the continuous recording sheet in a precutting position separated a predetermined length from a front edge of the continuous recording sheet, to remove a front edge portion.

Furthermore, a platen is disposed to face the thermal head. A shifter mechanism is controlled by the controller, for moving one of the thermal head and the platen toward a remainder thereof while the feeder is actuated, to press the continuous cleaning sheet against the thermal head.

After the thermal head is cleaned, the cutter cuts the continuous cleaning in a cutting position separated a predetermined length from a front edge of the continuous cleaning sheet, to remove a front edge portion.

The controller causes the feeder to move back and forth the continuous cleaning sheet for a predetermined number of times.

The controller keeps the thermal head from being energized while the feeder feeds the continuous cleaning sheet.

The discernment information is a first indicia formed in the continuous cleaning sheet. The information reader includes a photoelectric sensor.

According to one aspect of the present invention, a head cleaning method of cleaning a thermal head includes a step of loading a pre-cleaning recording sheet roll including the continuous recording sheet wound in a roll form, and a cleaning region defined at a front edge portion of the continuous recording sheet. The thermal head is wiped and pre-cleaned with the cleaning region by feeding the cleaning region.

Furthermore, after the pre-cleaning step, the cleaning region is cut away from the continuous recording sheet.

The pre-cleaning recording sheet roll further includes discernment information provided in a predetermined position. Furthermore, the presence or absence of the discernment information is checked, wherein if the discernment information is present, the pre-cleaning step is effected.

The cleaning region comprises a cleaning abrasion layer overlaid on the front edge portion of the continuous recording sheet.

The cleaning abrasion layer is secured by adhesion.

According to another preferred embodiment, the cleaning abrasion layer is overlaid by coating.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
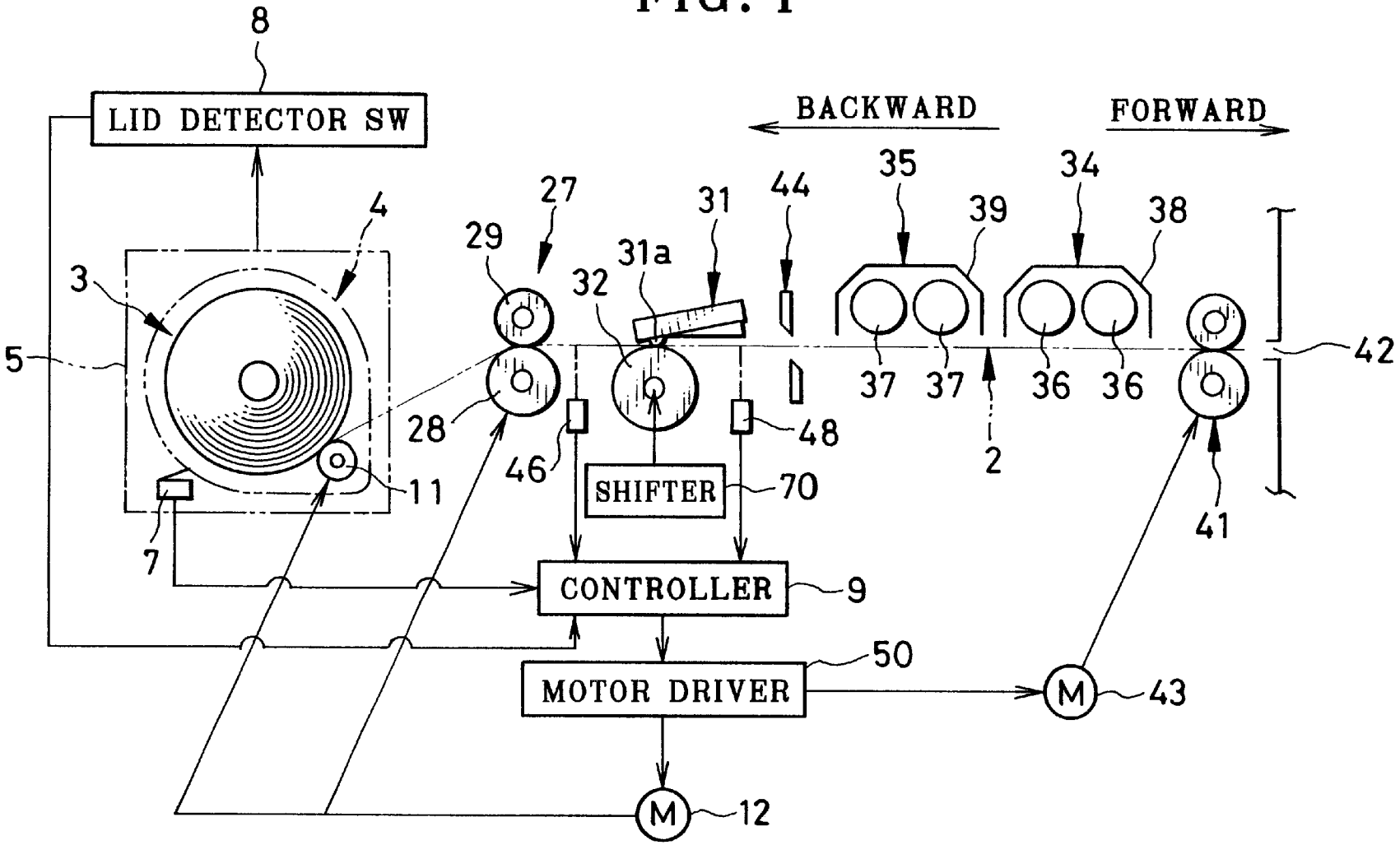
FIG. 1 is an explanatory view illustrating a color thermal printer.

In FIG. 1, a color thermal printer is illustrated. For use with the thermal printer, a recording sheet roll 3 is constituted by a continuous color thermosensitive recording sheet 2 wound in a roll form. The recording sheet roll 3, before being used, is accommodated in a box or the like capable of shielding light. To load the thermal printer with the recording sheet roll 3, a magazine 4 capable of shielding light is used to contain the recording sheet roll 3, and is set in a roll loading chamber 5.

There are a magazine detector switch 7 and a lid detector switch 8 disposed in the roll loading chamber 5. The magazine detector switch 7 is turned on when the presence of the magazine 4 is detected in the roll loading chamber 5. The lid detector switch 8 is turned on while a lid for the roll loading chamber 5 is closed. A controller 9 receives detection signals from the magazine detector switch 7 and the lid detector switch 8, and controls various elements of the thermal printer.

A supply roller 11 is incorporated inside the magazine 4 to contact the outermost turn of the recording sheet roll 3. A connecting gear (not shown) is disposed coaxially with the supply roller 11 and accessible from the outside of the magazine 4. When the magazine 4 is set in the roll loading chamber 5, the connecting gear becomes meshed with a driving gear incorporated in the roll loading chamber 5. A stepping motor 12 drives the driving gear, which rotates the recording sheet roll 3 in the counterclockwise direction to feed the continuous recording sheet 2 from the magazine 4, and rotates the recording sheet roll 3 in the clockwise direction to return the continuous recording sheet 2 into the magazine 4.

Figure 2A:
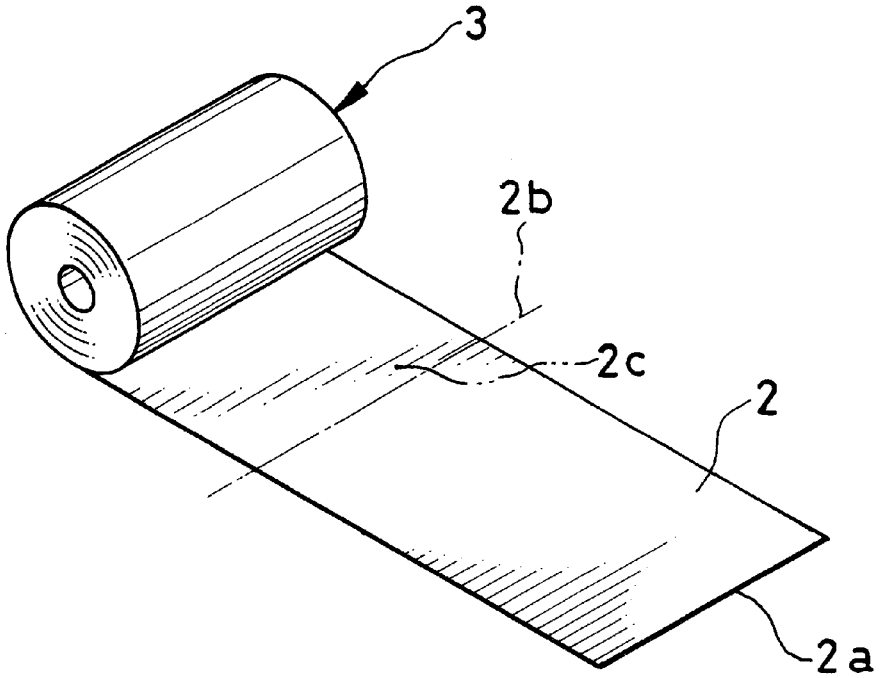
FIG. 2A is a perspective illustrating a recording sheet roll.
Figure 2B:
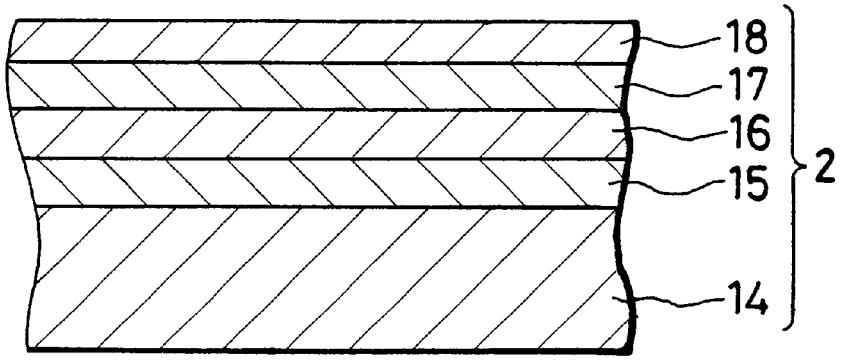
FIG. 2B is a section illustrating layers of a continuous recording sheet.

In FIGS. 2A and 2B, the continuous recording sheet 2 includes a support 14, cyan, magenta and yellow thermosensitive coloring layers 15, 16 and 17, and a protective layer 18, which are overlaid on one another. Among the coloring layers, the yellow coloring layer 17 is positioned the farthest from the support 14, and has the highest heat sensitivity. The cyan coloring layer 15 is positioned the closest to the support 14, and has the lowest heat sensitivity. The yellow coloring layer 17 has such fixability that its coloring ability is destroyed upon receiving near ultraviolet rays of 420 nm. The magenta coloring layer 16 has the second highest heat sensitivity, and such fixability that its coloring ability is destroyed upon receiving ultraviolet rays of 365 nm. Note that the continuous recording sheet 2 may have four thermosensitive coloring layers including a black coloring layers.

A front edge 2*a* of the continuous recording sheet 2 in the recording sheet roll 3 is shipped out as manufactured. It is likely that the front edge 2*a* is curved or inclined with reference to a direction perpendicular to lateral edges of the continuous recording sheet 2. To prevent a finished print from having the curved or inclined front edge with low quality, the thermal printer of the invention has a precutting structure for cutting the front edge 2*a* away from the continuous recording sheet 2 before the start of printing.

Figure 3A:
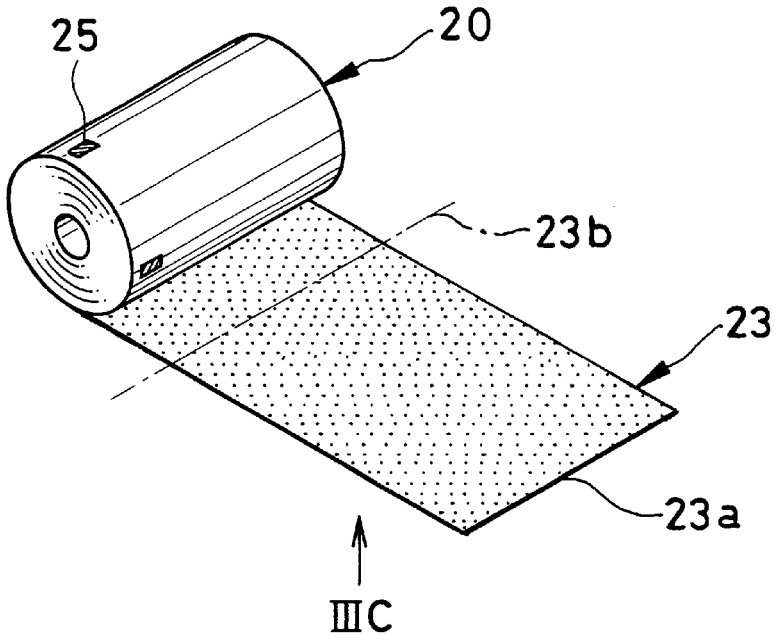
FIG. 3A is a perspective illustrating a cleaning sheet roll.
Figure 3B:
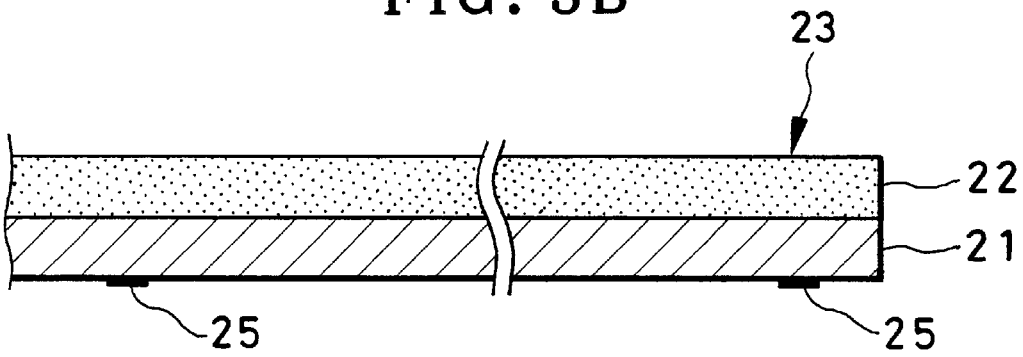
FIG. 3B is a section illustrating layers of a continuous cleaning sheet.

The thermal printer is also loadable with a cleaning sheet roll 20 instead of the recording sheet roll 3. In FIGS. 3A and 3B, a continuous cleaning sheet 23 is wound to define the cleaning sheet roll 20, of which the appearance is nearly the same as that of the recording sheet roll 3. The continuous cleaning sheet 23 is constituted by a support 21 and a cleaning abrasion layer 22. The support 21 consists of paper, plastic film, of the like, and is sheet or film with a continuous length. The cleaning abrasion layer 22 consists of abrasion agent.

Figure 3C:
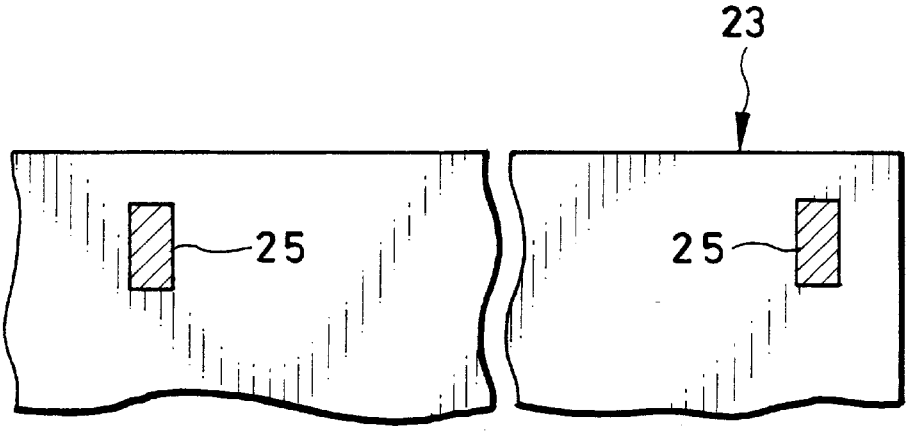
FIG. 3C is a plan illustrating the continuous cleaning sheet with a discernment indicia.

FIG. 3C is a plan of the continuous cleaning sheet 23 as viewed in the direction of the arrow IIIC in FIG. 3A. A first discernment indicia 25 is printed on a back surface of the continuous cleaning sheet 23, arranged at a regular pitch in its longitudinal direction, and has a rectangular quadrilateral shape. The first discernment indicia 25 is detected by a sensor in the printer, and informs that the cleaning sheet roll 20 is set as a roll different from the recording sheet roll 3.

The cleaning sheet roll 20 is set in the thermal printer for a process of inspection and maintenance. To set the cleaning sheet roll 20, the cleaning sheet roll 20 is inserted in the magazine 4 at first in the same manner as the recording sheet roll 3. The supply roller 11 rotates to advance a front edge 23*a* of the continuous cleaning sheet 23 to the outside of the magazine 4. The continuous cleaning sheet 23 frictionally contacts a heating element array, and eliminates dirt and dust from the same, as will be described later in detail.

A feeder 27 is disposed downstream from the supply roller 11 in the feeding direction of the continuous recording sheet 2. The feeder 27 includes a capstan roller 28 and a pinch roller 29. The capstan roller 28 is under a path for the continuous recording sheet 2 and is driven by the stepping motor 12. The pinch roller 29 is above the path for the continuous recording sheet 2, and is caused to contact the capstan roller 23 by a cam, solenoid or the like. The feeder 27 squeezes the continuous recording sheet 2 by pressure of the pinch roller 29, and moves the continuous recording sheet 2 in the forward and backward directions by rotation of the capstan roller 28, the backward direction being an image recording direction. A feeding amount of the continuous recording sheet 2 is calculated according to the number of rotations of the pinch roller 29 counted by a counter.

A thermal head 31 is disposed downstream from the feeder 27 in the forward direction of feeding. A heating element array 31*a* is included in the thermal head 31, is opposed to the continuous recording sheet 2, and includes a great number of heating elements linearly arranged in the width direction of the continuous recording sheet 2. A platen roller 32 is disposed below the continuous recording sheet 2 in a rotatable manner, and opposed to the thermal head 31. The platen roller 32 is movable up and down. A spring biases the platen roller 32 in a direction to press the thermal head 31, and constitutes a shifter mechanism 70.

While the continuous recording sheet 2 is moved by the feeder 27 in the backward direction for image recording, the platen roller 32 is kept raised, to press the continuous recording sheet 2 against the thermal head 31. The thermal head 31 is operated according to printing data. The heating element array 31*a* is caused to generate heat at a determined temperature, to develop color in the coloring layers in the continuous recording sheet 2. The platen roller 32 is caused by feeding of the continuous recording sheet 2 to rotate. At the time of forward and backward movement of the continuous recording sheet 2, the platen roller 32 is kept lowered by the cam, solenoid or the like, to define a space with the thermal head 31.

A yellow fixer 34 and a magenta fixer 35 are disposed downstream from the thermal head 31, and opposed to the continuous recording sheet 2. The yellow fixer 34 has a lamp 36 and a reflector 38. The magenta fixer 35 has an ultraviolet lamp 37 and a reflector 39. The lamp 36 in the yellow fixer 34 emits near ultraviolet rays of which a peaking wavelength is 420 nm. The ultraviolet lamp 37 in the magenta fixer 35 emits near ultraviolet rays of which a peaking wavelength is 365 nm. The lamp 36 fixes the yellow coloring layer 17. Namely, the yellow coloring layer 17 after the fixation does not develop color even upon receiving further heat energy. Similarly, the ultraviolet lamp 37 fixes the magenta coloring layer 16.

There are an ejector roller set 41 and an exit slot 42 disposed downstream from the yellow fixer 34 in the forward direction. A stepping motor 43 drives the ejector roller set 41. When printing is completed, a cutter 44 cuts the continuous recording sheet 2 between the thermal head 31 and the magenta fixer 35 to obtain a print sheet, which is ejected by the ejector roller set 41 from the exit slot 42. Thus, a user can be provided with the print sheet.

Plural guide members (not shown) are disposed inside the thermal printer for guiding the continuous recording sheet 2. The continuous recording sheet 2 from the recording sheet roll 3 is passed in the feeder 27, between the thermal head 31 and the platen roller 32, and then under the fixers 34 and 35, and to the exit slot 42 while guided by the guiding members.

A sheet edge sensor 46 is disposed between the feeder 27 and the thermal head 31, and detects the front edge 2*a* of the continuous recording sheet 2. An example of the sheet edge sensor 46 is a reflection type of photoelectric sensor, and detects passage of the front edge 2*a* of the continuous recording sheet 2 in the feeder 27. A signal from the sheet edge sensor 46 is utilized to determine the time when the feeder 27 should nip the continuous recording sheet 2. The signal from the sheet edge sensor 46 is input to the controller 9.

Also, an information reading photoelectric sensor 48 as an element in a mode setter is disposed between the thermal head 31 and the cutter 44 for discerning which type of roll is set in the printer. An example of the information reading sensor 48 is a reflection type, and is opposed to the back surface of the continuous recording sheet 2 or the continuous cleaning sheet 23. If the cleaning sheet roll 20 is set in the roll loading chamber 5, the information reading sensor 48 detects the first discernment indicia 25 printed behind the continuous cleaning sheet 23, and sends a detection signal to the controller 9.

The controller 9 includes a CPU, program ROM, data ROM, work RAM and the like, and controls various elements included in the thermal printer according to inputs as received. A motor driver 50 is controlled by the controller 9, and drives the stepping motors 12 and 43 for driving the rollers.

Figure 4:
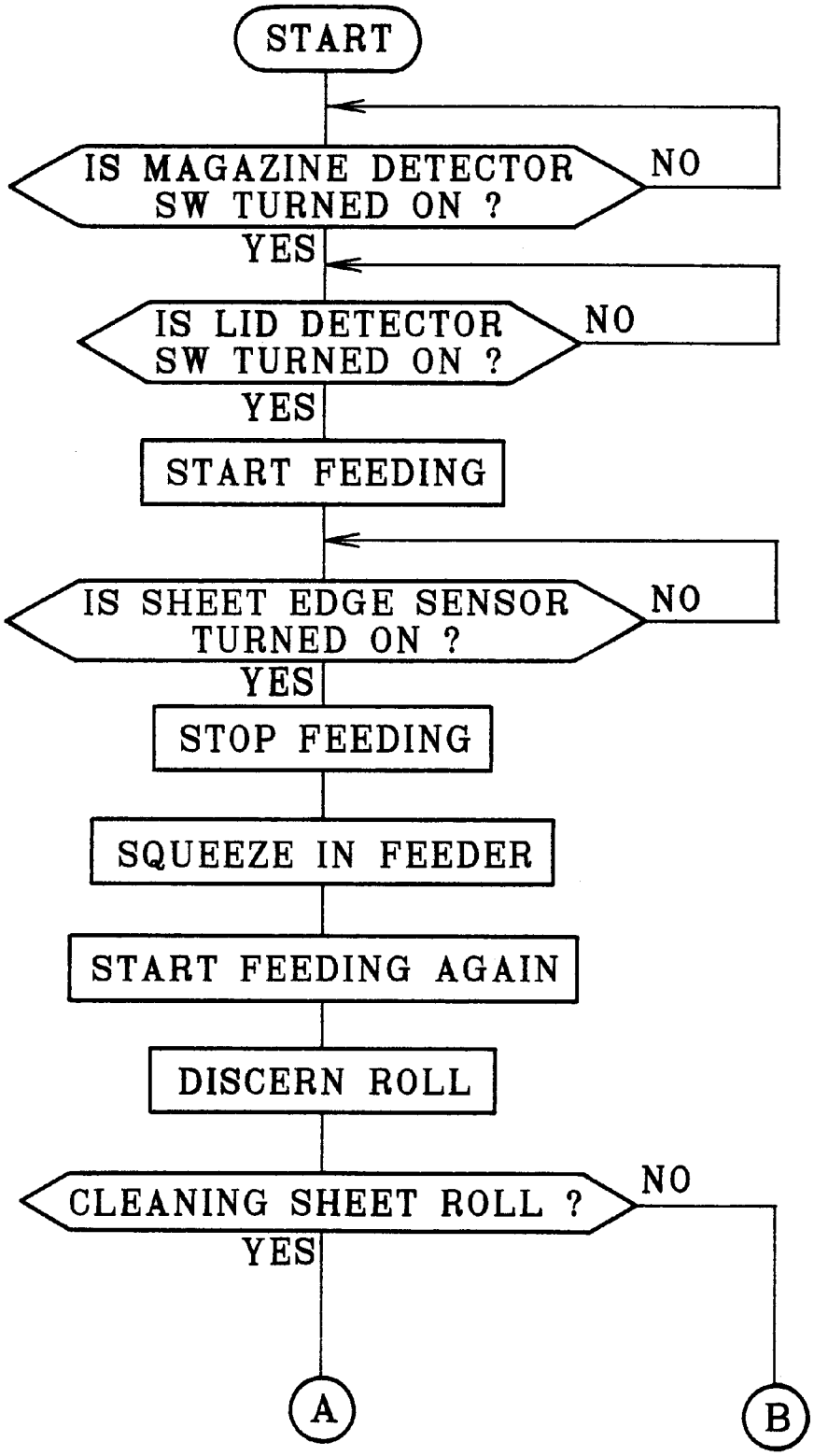
FIG. 4 is a glow chart illustrating a beginning portion of operation of the thermal printer.
Figure 5:
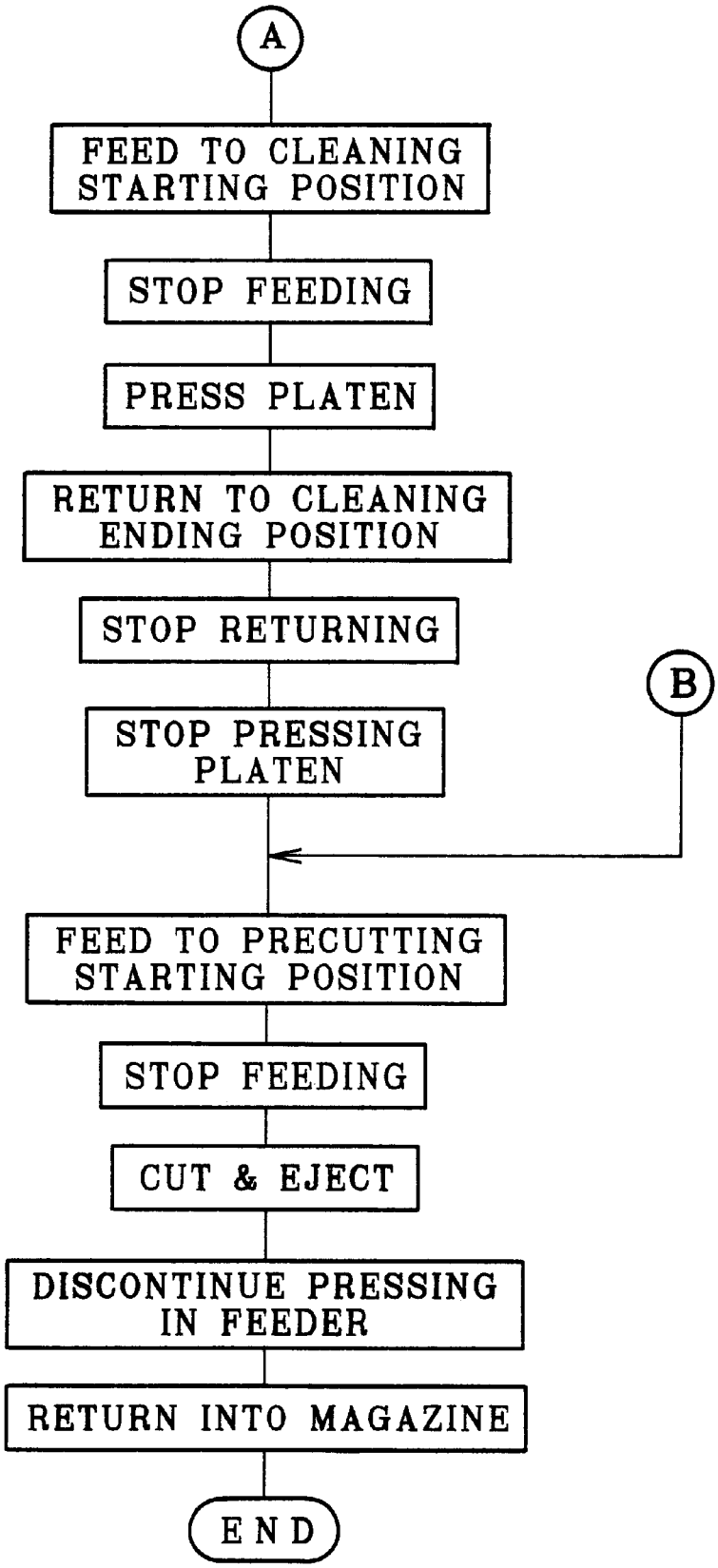
FIG. 5 is a flow chart illustrating a portion of the operation succeeding to that of the FIG. 4.

The operation of the construction is described with reference to FIGS. 4 and 5. To use the thermal printer, the recording sheet roll 3 is set at first. In an unused state, the recording sheet roll 3 is sold as contained in a box or any light-shielded package. A user takes the recording sheet roll 3 out of the box, and inserts the recording sheet roll 3 in the magazine 4. Then the lid of the roll loading chamber 5 is opened. The user sets the magazine 4 in the roll loading chamber 5.

When the magazine 4 is set in the roll loading chamber 5, the magazine detector switch 7 is turned on in the roll loading chamber 5. A detection signal from the magazine detector switch 7 is input to the controller 9. Then a chamber lid is closed with the magazine 4 set in the roll loading chamber 5, to turn on the lid detector switch 8. Also, a detection signal from the lid detector switch 8 is input to the controller 9.

When the controller 9 receives detection signals from the magazine detector switch 7 and the lid detector switch 8, the controller 9 starts a precutting process because the continuous recording sheet 2 is ready to be supplied. In the precutting process, the motor driver 50 is caused to rotate the stepping motor 12 in the forward direction. Forward rotation of the stepping motor 12 is transmitted to the supply roller 11 in the magazine 4 by a driving gear and transmission gear (not shown). The recording sheet roll 3 is rotated in the counterclockwise direction as viewed in FIG. 1.

When the recording sheet roll 3 is rotated in the counterclockwise direction, the front edge 2*a* of the continuous recording sheet 2 is advanced out of the magazine 4 through its passage slot. The guide members (not shown) guide movement of the continuous recording sheet 2 in the forward direction. The front edge 2*a* of the continuous recording sheet 2 becomes located between the pinch roller 29 and the capstan roller 28 in the feeder 27. After the front edge 2*a* passes the feeder 27, the front edge 2*a* is detected by the sheet edge sensor 46.

When the sheet edge sensor 46 detects the front edge 2*a* of the continuous recording sheet 2, a detection signal is input to the controller 9. At the same time as inputting of the detection signal, the controller 9 stops driving the stepping motor 12, and causes the pinch roller 29 to press the capstan roller 28. When the feeder 27 squeezes the continuous recording sheet 2, the controller 9 starts again rotating the stepping motor 12 in the forward direction. Thus, the continuous recording sheet 2 is fed by the feeder 27 in the forward direction.

The continuous recording sheet 2, fed in the forward direction by the feeder 27, is passed between the thermal head 31 and the platen roller 32, to cause the information reading sensor 48 to scan its back surface. The back surface of the continuous recording sheet 2 does not have a discernment indicia. No detection signal is generated by the information reading sensor 48. The controller 9 recognizes that the recording sheet roll 3 is set because of lack of an input from the information reading sensor 48.

Upon detecting the setting of the recording sheet roll 3, the controller 9 starts the precutting process. At first, the front edge 2*a* of the continuous recording sheet 2 is fed to the precutting starting position, which is defined between rollers in the ejector roller set 41 opposed to each other.

The controller 9 counts the number of rotations of the pinch roller 29 in the feeder 27 after detection of the front edge 2*a* of the continuous recording sheet 2 by the sheet edge sensor 46, and obtains a feeding amount of the continuous recording sheet 2 according to the number of rotations. When the front edge 2*a* comes to the ejector roller set 41, rotation of the stepping motor 12 is discontinued. The ejector roller set 41 squeezes the continuous recording sheet 2.

At the same time as nipping of the continuous recording sheet 2 in the ejector roller set 41, the controller 9 actuates the cutter 44 to cut the continuous recording sheet 2 along a precutting line 2*b* in FIG. 2. After the cutting, the controller 9 causes the stepping motor 43 to rotate forwards. An unwanted front portion of the continuous recording sheet 2 is ejected from the exit slot 42 to the outside of the thermal printer. The stepping motor 12 rotates backwards, to rotate the supply roller 11 and the feeder 27 in the backward direction for image recording, to wind back the continuous recording sheet 2 toward the inside of the magazine 4. Then the thermal printer becomes ready for printing operation upon newly setting the recording sheet roll 3.

When a start command signal is entered in the printer, the stepping motor 12 starts rotation in the forward direction. The supply roller 11 rotates the recording sheet roll 3 in the counterclockwise direction, to advance a new front edge 2*c* of the continuous recording sheet 2 out of the magazine 4. The continuous recording sheet 2 is fed to the feeder 27. The sheet edge sensor 46 detects the new front edge 2*c*. The controller 9 receives a detection signal from the sheet edge sensor 46, causes the pinch roller 29 to contact the capstan roller 28, to squeeze the continuous recording sheet 2.

In the feeder 27, the capstan roller 28 rotates to feed the continuous recording sheet 2 toward the thermal head 31. The continuous recording sheet 2 is passed between the thermal head 31 and the platen roller 32, and fed further in the forward direction. When the number of rotations of the pinch roller 29 in the feeder 27 reaches a number corresponding to a predetermined feeding amount for the continuous recording sheet 2, the stepping motor 12 is stopped. The controller 9 stops driving the cam, solenoid or the like, which has been lowering the platen roller 32. The spring in the shifter mechanism 70 moves up the platen roller 32 to squeeze the continuous recording sheet 2 in cooperation with the thermal head 31.

Then the controller 9 causes the stepping motor 12 to rotate backwards, to rotate the supply roller 11 and the feeder 27 in the backward direction for image recording. Thus, the continuous recording sheet 2 is moved in the backward direction toward the left in FIG. 1. A front edge of a recording region in the continuous recording sheet 2 reaches the thermal head 31. Then the heating element array 31*a* is driven to apply heat to the recording region. A yellow image is recorded thermally to the cyan coloring layer 15 one line after another.

Upon completion of yellow recording to the recording region in the continuous recording sheet 2 including a final line, the stepping motor 12 is stopped. The platen roller 32 is lowered away from the thermal head 31 by the cam, solenoid or the like. Again, the stepping motor 12 rotates forwards. The feeder 27 rotates to feed the continuous recording sheet 2 in the forward direction. At the same time, the lamp 36 in the yellow fixer 34 is turned on to fix the cyan coloring layer 15 in the continuous recording sheet 2.

When the fixation of the cyan coloring layer 15 in the continuous recording sheet 2 is completed, the stepping motor 12 is stopped. Also, actuation of the cam, solenoid and the like for lowering the platen roller 32 is discontinued. Again, the spring in the shifter mechanism 70 moves up the platen roller 32, to squeezes the continuous recording sheet 2 with the thermal head 31. The controller 9 causes the stepping motor 12 to rotate backwards. The feeder 27 is rotated backwards. The continuous recording sheet 2 is moved in the backward direction for image recording. The front edge of the recording region in the continuous recording sheet 2 reaches the thermal head 31. Then the heating element array 31*a* is driven to apply heat to the recording region. A magenta image is recorded thermally to the magenta coloring layer 16 one line after another.

Upon completion of magenta recording to the recording region in the continuous recording sheet 2 including the final line, the stepping motor 12 is stopped. The platen roller 32 is lowered away from the thermal head 31 by the cam, solenoid or the like. Again, the stepping motor 12 rotates forwards, to feed the continuous recording sheet 2 in the forward direction. At the same time, the ultraviolet lamp 37 in the magenta fixer 35 is turned on to fix the magenta coloring layer 16 in the recording region in the continuous recording sheet 2.

When the fixation of the magenta coloring layer 16 in the continuous recording sheet 2 is completed, the stepping motor 12 is stopped. Also, actuation of the mechanism for lowering the platen roller 32 is discontinued. The spring in the shifter mechanism 70 moves up the platen roller 32, to squeeze the continuous recording sheet 2 with the thermal head 31. The stepping motor 12 rotates backwards, so the continuous recording sheet 2 is moved in the backward direction for image recording. The front edge of the recording region in the continuous recording sheet 2 reaches the thermal head 31. The heating element array 31*a* is driven to apply heat to the recording region. A cyan image is recorded thermally to the yellow coloring layer 17 one line after another.

Upon completion of cyan recording to the recording region in the continuous recording sheet 2 including the final line, the stepping motor 12 is stopped. The platen roller 32 is lowered away from the thermal head 31 by the cam, solenoid or the like. Then the stepping motor 12 rotates forwards, to feed the continuous recording sheet 2 in the forward direction. There is no fixing operation, because the yellow coloring layer 17 is not colored in a normally preserved state, and does not have fixability.

Then the continuous recording sheet 2 is ejected. The controller 9 stops rotation of the stepping motor 12, and actuates the cutter 44. The continuous recording sheet 2 is cut to obtain a full-color print sheet. Then the controller 9 causes the stepping motor 43 to rotate in the forward direction. The ejector roller set 41 is rotated in the ejecting direction, to eject the print sheet from the exit slot 42 to the outside of the printer. If no more print sheet is desired, the printing operation is completed. The continuous recording sheet 2 is wound back entirely into the magazine 4 and protected moisture or high humidity.

After the above-described printing operation is repeated, it is likely that dirt, dust or the like sticks to the heating element array 31*a* of the thermal head 31. The dirt may have been stuck on the continuous recording sheet 2. The dust may be particles created from the protective layer 18 in the continuous recording sheet 2. Thus, it is necessary to clean the thermal head 31 periodically.

The cleaning sheet roll 20 in FIG. 3 is contained in the magazine 4 in the same manner as the recording sheet roll 3, and set in the thermal printer. After setting of the magazine 4 and closing the chamber lid, rotation of the stepping motor 12 is started in the forward direction. The front edge 23*a* of the continuous cleaning sheet 23 is advanced from the magazine 4. The continuous cleaning sheet 23 is passed in the feeder 27. The sheet edge sensor 46 detects the front edge 23*a* in the same manner as the continuous recording sheet 2. Then the feeder 27 feeds the continuous cleaning sheet 23 in the feeding path.

The continuous cleaning sheet 23 is passed between the thermal head 31 and the platen roller 32. The first discernment indicia 25 behind the continuous cleaning sheet 23 is detected by the information reading sensor 48. A detection signal from the information reading sensor 48 is input to the controller 9. The controller 9 recognizes the presence of the cleaning sheet roll 20, and starts a cleaning process. At first, the continuous cleaning sheet 23 is fed to a cleaning starting position, which is defined where the front edge 23*a* is positioned in the ejector roller set 41.

The controller 9 stops the stepping motor 12 when the front edge 23*a* comes into the ejector roller set 41. Then the platen roller 32 is raised to squeeze the continuous cleaning sheet 23 with the thermal head 31. The cleaning abrasion layer 22 of the continuous cleaning sheet 23 is pressed against the heating element array 31*a*. Then the stepping motor 12 is rotated backwards. The continuous cleaning sheet 23 frictionally wipes dust or dirt away from the heating element array 31*a* by moving toward the magazine 4.

When the cleaning process is completed, then the precutting process is executed. The portion of the continuous cleaning sheet 23 rubbed with the heating element array 31*a* is cut away along a cutting line 23*b* in FIG. 3. This is effective in next use of an unused portion of the continuous cleaning sheet 23, to optimize the quality in next cleaning operation. After the precutting process, the cleaning sheet roll 20 is removed from the roll loading chamber 5. Instead, the recording sheet roll 3 is set in the roll loading chamber 5 again. It is possible to use the thermal head 31 in a cleaned state for printing operation.

This being so, the thermal printer, if the cleaning sheet roll 20 is set, does not execute the precutting process for the continuous recording sheet 2 initially. The continuous cleaning sheet 23 can be utilized for wiping operation without being wasted. Also, the cleaning process can be effected automatically upon setting the cleaning sheet roll 20. Operation of maintaining the thermal printer can be facilitated, to increase the ease in the handling.

In the above embodiments, the continuous cleaning sheet 23 is returned for one time to complete the cleaning process. Alternatively, the continuous cleaning sheet 23 in the cleaning process may be moved back and forth a number of times to wipe the heating element array 31*a*. A sequence of back and forth movement may be programmed with the number of the times, and may be written to a program ROM in the controller 9. Also, an operation panel may be provided in the printer in an externally operable manner, and may be operated by a user to input values for the sequence of the back and forth movement.

Figure 6A:
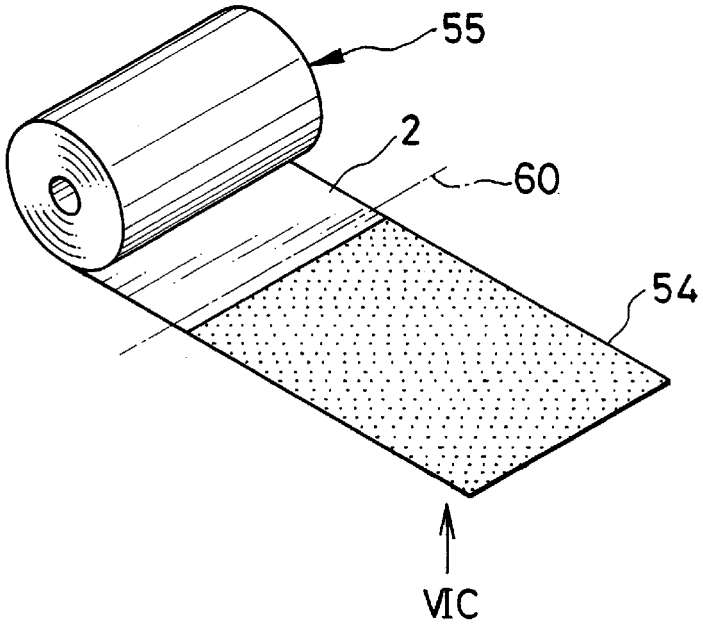
FIG. 6A is a perspective illustrating a pre-cleaning recording sheet roll.
Figure 6B:
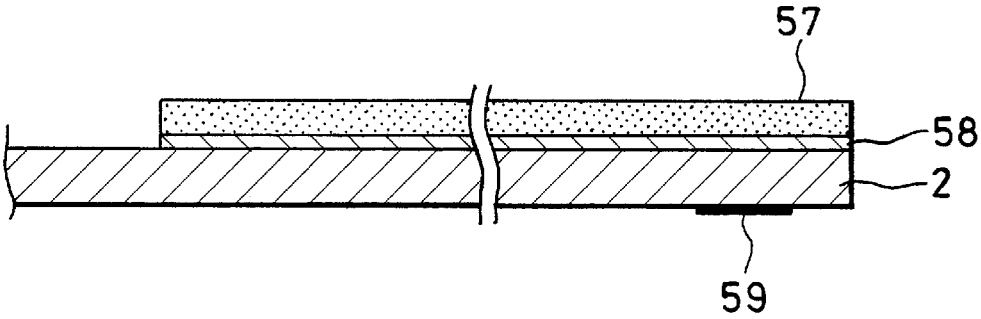
FIG. 6B is a section illustrating the continuous recording sheet with a cleaning region and a discernment indicia.

In FIGS. 6A and 6B, another preferred embodiment is illustrated, in which a pre-cleaning recording sheet roll 55 is used. The pre-cleaning recording sheet roll 55 includes the continuous recording sheet 2 wound in a roll form, and a cleaning region 54 defined at a front edge of the continuous recording sheet 2 as a sheet portion to operate in the same manner as the continuous cleaning sheet 23.

Figure 6C:
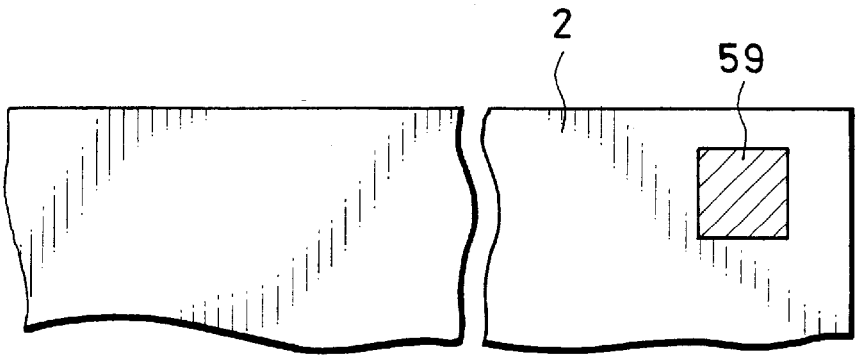
FIG. 6C is a plan illustrating the continuous cleaning sheet with a discernment indicia.

The pre-cleaning recording sheet roll 55 includes a cleaning abrasion layer 57 and a double-sided adhesive tape 58. The cleaning abrasion layer 57 constituting the cleaning region 54 is a sheet formed from paper, plastic film or the like, and has abrasion agent mixed therein. The double-sided adhesive tape 58 attaches the cleaning abrasion layer 57 to the continuous recording sheet 2. FIG. 6C is a plan viewed in the direction of the arrow VIC in FIG. 6A. A second discernment indicia 59 is printed on the back surface of the continuous recording sheet 2, and different from the first discernment indicia 25 of the cleaning sheet roll 20. When the information reading sensor 48 detects the second discernment indicia 59, setting of the pre-cleaning recording sheet roll 55 is recognized. Note that a precutting line 60 is located in the continuous recording sheet 2. The cleaning region 54 and the second discernment indicia 59 are disposed downstream from the precutting line 60. Thus, the pre-cleaning recording sheet roll 55 after the precutting process becomes the same as the recording sheet roll 3 of a normal type.

When the pre-cleaning recording sheet roll 55 is set in the thermal printer, the information reading sensor 48 detects the second discernment indicia 59. Upon the detection, the controller 9 executes the pre-cleaning process in the same manner as the process with the cleaning sheet roll. The continuous recording sheet 2 is precut along the precutting line 60. Then the controller 9 recognizing the pre-cleaning recording sheet roll 55 executes the printing process immediately after the precutting process. This is unlike the operation with the cleaning sheet roll 20, with which there is a printing process only after the cleaning sheet roll 20 is replaced with the recording sheet roll 3.

At each time that the pre-cleaning recording sheet roll 55 in an unused state is set in the thermal printer, the thermal head 31 is cleaned. Thus, the thermal head 31 can operate for printing constantly in a cleaned state. No periodical cleaning is required. The entirety of the maintenance of the thermal printer can be simplified.

Figure 7:
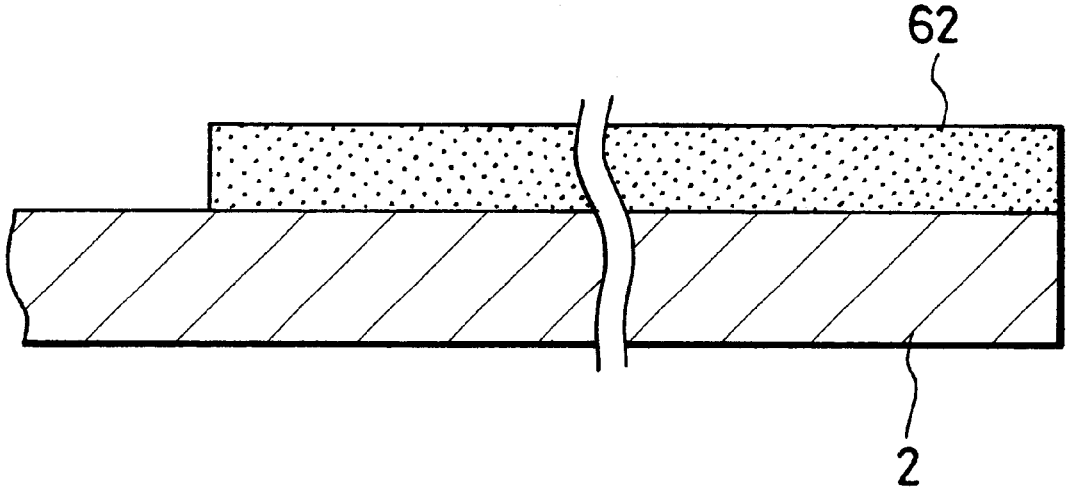
FIG. 7 is a section illustrating a cleaning region with the continuous recording sheet in another preferred pre-cleaning recording sheet roll.

In the pre-cleaning recording sheet roll 55, the cleaning abrasion layer 57 is attached to the continuous recording sheet 2 by the double-sided adhesive tape 58. Also, another pre-cleaning recording sheet roll can have the continuous recording sheet 2, as depicted in FIG. 7, in which a front edge region can be coated with abrasion agent to define a cleaning region 62 with a cleaning abrasion layer.

Furthermore, still another pre-cleaning recording sheet roll can have such a structure in which a cleaning sheet can be attached to a front edge of the continuous recording sheet by adhesive agent applied to their adhering region with a small width.

In the above embodiments, the types of the roll are automatically discerned. Alternatively, a precutting switch or button may be provided in the printer for executing the precutting process as desired by a user. At each time that the precutting switch is operated, the discernment of the roll types, the cleaning process and the precutting process are effected according to the flows in FIGS. 4 and 5.

In the above embodiments, the precutting process precuts a front portion of the continuous recording sheet 2 in the recording sheet roll 3 at a predetermined precutting length. A front portion of the continuous cleaning sheet 23 in the cleaning sheet roll 20 is cut away at a predetermined cutting length. Also, the cleaning region 54 in the pre-cleaning recording sheet roll 55 is cut away at a predetermined cutting length. Those cutting lengths are equal to a size of a print sheet to be obtained in the feeding direction. However, those cutting lengths may be different from one another. The precutting length for the recording sheet roll 3 can be considerably small end very near to zero in view of minimizing a waste sheet. The cutting length for the pre-cleaning recording sheet roll 55 can be equal to or more than the length of the cleaning region 54.

In the above embodiments, the discernment indicia 25 and 59 is printed in the back surface of respectively the continuous cleaning sheet 23 and the continuous recording sheet 2. However, the discernment indicia 25 and 59 may be printed respectively in a front surface of the continuous cleaning sheet 23 and in the recording surface of the continuous recording sheet 2.

Furthermore, the discernment indicia 25 and 59 may be replaced with holes in a suitable shape, magnetic information magnetically recorded in a magnetic recording layer, or the like. Also, a spool core for use with the cleaning sheet roll 20 and the pre-cleaning recording sheet roll 55 may be provided with discernment information to be read by a sensor in the roll loading chamber in the thermal printer.

In the above embodiments, the thermal printer is the color thermal printer of a direct recording type. Furthermore, a thermal printer according to the invention can be a monochromatic printer, a thermal transfer printer of a sublimation type or wax transfer type for use with an ink sheet, or the like.

Also, the thermal printer can be used also with a non-standard recording sheet, for example, a continuous recording sticker sheet. The thermal printer is loadable with a recording sticker sheet roll, and capable of recording an image to the continuous recording sticker sheet unwound from the recording sticker sheet roll, to obtain sticker prints or seal prints. The continuous recording sticker sheet includes a thermosensitive recording sheet, a laminate layer, an adhesive layer and a release sheet overlaid on a back surface of the thermosensitive recording sheet in sequence. In the thermosensitive recording sheet are arranged plural sticker chips in a matrix form. The sticker chips are regions defined by cutting lines extending in shapes of quadrilaterals. After an image is printed to each of the sticker chips, the sticker chips are peeled from the release sheet. It is possible with the adhesive layer to attach the sticker chips to a notebook, handbook and the like.

The thermal printer is constructed so that, in the precutting process, the thermal head is kept pressed to the continuous recording sticker sheet if loading of the recording sticker sheet roll is detected. It is also possible to construct a thermal printer to keep the thermal head away from the continuous recording sticker sheet if the recording sticker sheet roll is detected, in the same manner as for the ordinary type of the recording sheet roll.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A head cleaning method of cleaning a thermal head of a thermal printer, said thermal printer being capable of a precutting operation in which, when a recording sheet roll is set, a front edge portion of a continuous recording sheet is fed from said recording sheet roll to a cutter, and said cutter cuts away said recording sheet front edge portion, said head cleaning method comprising the steps of:

setting one of said recording sheet roll and a cleaning sheet roll in said thermal printer, said cleaning sheet roll including a continuous cleaning sheet wound in a roll form;

determining which of said recording sheet roll and said cleaning sheet roll is set in said thermal printer by reading discernment information;

if said cleaning sheet roll is determined, feeding a front edge portion of said continuous cleaning sheet with said thermal head pressed on said cleaning sheet front edge portion, to clean said thermal head;

precutting away said recording sheet front edge portion or said cleaning sheet front edge portion with said cutter.

2. A head cleaning method as defined in claim 1, further comprising a step of, if said recording sheet roll is determined, feeding said recording sheet front edge portion with said thermal head away from said recording sheet front edge portion.

3. A head cleaning method as defined in claim 2, wherein said cleaning sheet front edge portion is precut at a length equal to a length at which said recording sheet front edge portion is precut.

4. A head cleaning method as defined in claim 3, wherein said cleaning sheet front edge portion is moved back and forth for a predetermined number of times before being precut.

5. A head cleaning method as defined in claim 4, wherein said thermal head is kept from being energized while cleaned.

6. A head cleaning method as defined in claim 5, wherein said discernment information is provided in said cleaning sheet roll to represent the presence of said cleaning sheet roll.

7. A head cleaning method as defined in claim 6, wherein said continuous cleaning sheet includes a cleaning abrasion layer overlaid thereon to define an abrasion surface, for abrading said thermal head.

8. A head cleaning method as defined in claim 7, wherein said discernment information is an optical indicia disposed on said abrasion surface or a back surface reverse thereto and arranged in a regular pattern.

9. A head cleaning method of cleaning a thermal head of a thermal printer, said thermal printer being capable of a precutting operation, said head cleaning method comprising the steps of:

setting a recording sheet roll in said thermal printer, said recording sheet roll including a continuous recording sheet wound in a roll form, and a cleaning region defined at a front edge portion of said continuous recording sheet;

feeding said cleaning region of said continuous recording sheet from said recording sheet roll to a cutter, said thermal head being kept pressed on said cleaning region while said continuous recording sheet is fed, to clean said thermal head; and precutting away said cleaning region with said cutter.

10. A head cleaning method as defined in claim 9, wherein said cleaning region is moved back and forth for a predetermined number of times before being precut.

11. A head cleaning method as defined in claim 10, wherein said thermal head is kept from being energized while cleaned.

12. A head cleaning method as defined in claim 11, wherein said cleaning region includes a cleaning abrasion layer for abrading said thermal head.

13. A thermal printer capable of a precutting operation, comprising:

a roll loading station for being loaded with one of a recording sheet roll and a cleaning sheet roll, said recording sheet roll including a continuous recording sheet wound in a roll form, said cleaning sheet roll including a continuous cleaning sheet wound in a roll form;

a feeder for feeding said continuous recording sheet or said continuous cleaning sheet from said roll loading station;

a determiner for determining a roll type at said roll loading station by reading discernment information with which said recording sheet roll and said cleaning sheet roll are determined;

a shifter, actuated if said cleaning sheet roll is determined, for keeping said thermal head pressed on said continuous cleaning sheet while said continuous cleaning sheet is fed, to clean said thermal head; and a cutter for precutting away a front edge portion of said continuous recording sheet or said continuous cleaning sheet set in a cutting position downstream from said thermal head.

14. A thermal printer as defined in claim 13, wherein said shifter is actuated if said recording sheet roll is determined, for keeping said thermal head away from said continuous recording sheet while said continuous recording sheet is fed.

15. A thermal printer as defined in claim 14, wherein said feeder moves said front edge portion of said continuous cleaning sheet back and forth for a predetermined number of times before precutting of said cutter.

16. A thermal printer as defined in claim 15, further comprising a controller, wherein said controller keeps said thermal head from being energized while being cleaned.

17. A thermal printer capable of a precutting operation, comprising:

a roll loading station for being loaded with a recording sheet roll, said recording sheet roll including a continuous recording sheet wound in a roll form, and a cleaning region defined at a front edge portion of said continuous recording sheet for cleaning a thermal head;

a feeder for feeding said continuous recording sheet from said roll loading station;

a shifter for keeping said thermal head pressed on said cleaning region while said continuous recording sheet is fed, to clean said thermal head; and a cutter for precutting away said cleaning region set in a cutting position downstream from said thermal head.

18. A thermal printer as defined in claim 17, wherein said feeder moves said cleaning region back and forth for a predetermined number of times.

19. A thermal printer as defined in claim 18, further comprising a controller, wherein said controller keeps said thermal head from being energized while being cleaned.

20. A recording sheet roll in which a continuous recording sheet is wound in a roll form, comprising:

a cleaning region, defined at a front edge portion of said continuous recording sheet, for abrading dirt away from a thermal head when said continuous recording sheet passes said thermal head; and an indicator, formed in said cleaning region, for indicating the presence of said cleaning region to a detector within a thermal printer.

21. A recording sheet roll as defined in claim 20, wherein said cleaning region has a cleaning abrasion layer overlaid on said front edge portion.

22. A recording sheet roll as defined in claim 20, wherein said cleaning region has a cleaning abrasion sheet attached to said front edge portion.

23. A recording sheet roll as defined in claim 20, wherein said indicator comprises an optical indicator.

24. A recording sheet roll as defined in claim 20, wherein said indicator comprises magnetic information.

* * * * *